United States Patent [19]

Barnett et al.

[11] Patent Number: 4,538,387

[45] Date of Patent: Sep. 3, 1985

[54] DRAINAGE AND INSULATING MATERIAL FOR SUBTERRANEAN WALLS

[76] Inventors: Loren A. Barnett, 920 Durward Hall Dr.; Clayton C. Smith, 1006 Durward Hill Dr., both of Carthage, Mo. 64836

[21] Appl. No.: 557,243

[22] Filed: Dec. 2, 1983

[51] Int. Cl.[3] ..... E02D 31/02

[52] U.S. Cl. ..... 52/169.5; 52/169.14; 52/302; 428/167

[58] Field of Search ..... 52/169.5, 169.14, 309.4, 52/809, 302; 428/167

[56] References Cited

U.S. PATENT DOCUMENTS

| | | | |
|---|---|---|---|
| 3,353,315 | 11/1967 | Barker | 428/167 X |
| 3,740,909 | 6/1973 | Stinnes | 52/315 X |
| 3,754,362 | 8/1973 | Daimler et al. | 428/296 X |
| 4,439,066 | 3/1984 | McNally | 52/169.5 X |

FOREIGN PATENT DOCUMENTS

| | | | |
|---|---|---|---|
| 2263896 | 7/1974 | Fed. Rep. of Germany | 52/169.5 |
| 2925513 | 1/1981 | Fed. Rep. of Germany | 52/169.14 |
| 2442921 | 6/1980 | France | 428/167 |

*Primary Examiner*—Henry F. Epstein
*Attorney, Agent, or Firm*—John A. Hamilton

[57] ABSTRACT

A water drainage and thermal insulating material for subterranean walls consisting of a panel adapted to be applied to the exterior surface of a wall prior to applying earth or other backfill material to its outer surface. The panel consists of a relatively thick slab of thermal insulating material, both surfaces thereof being grooved in a diamond pattern to provide water flow passages, the slab being completely wrapped in a filter cloth fabric with a layer of loosely compacted fibrous material secured to the surface thereof confronting the slab. All of the materials are substantially impervious to ground moisture.

13 Claims, 7 Drawing Figures

DRAINAGE AND INSULATING MATERIAL FOR SUBTERRANEAN WALLS

Figures 1, 2, 3:
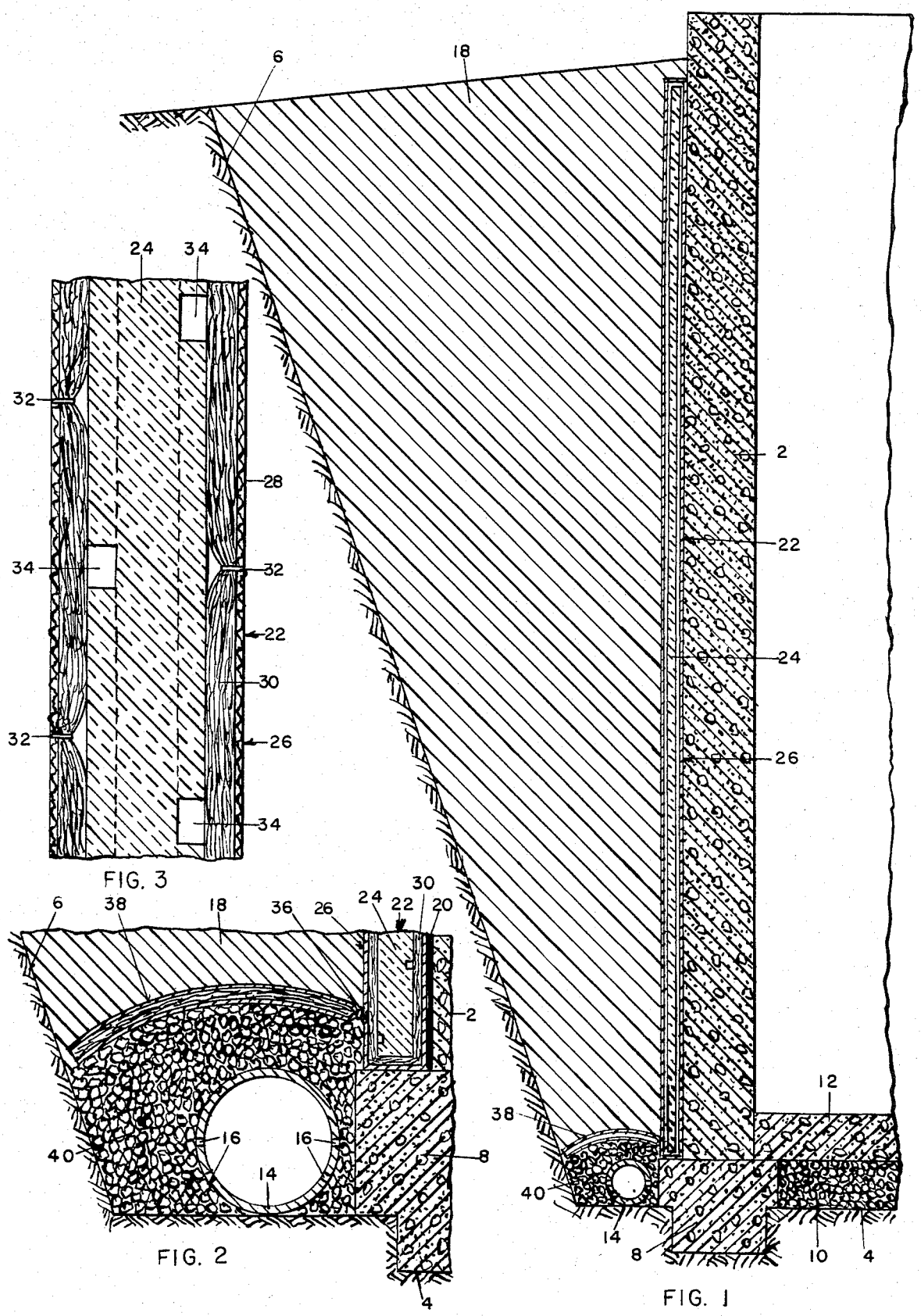

This invention relates to new and useful improvements in means for preventing or inhibiting the passage of ground moisture through subterranean walls into the interior of dwelling basements and the like, and also for providing thermal insulation for such walls to prevent the formation of moisture condensate on the interior surfaces of such walls. The inconvenience and expense to homeowners caused by basement leakage and "wet walls" are far too prevalent, widespread and well known to require detailed description herein, and the provision of means for substantially eliminating these problems is the overall object of the present invention.

More specifically, an object of the present invention is the provision of a material including a slab of substantially moisture impervious thermal insulating adapted to be applied to the exterior surface of a subterranean wall. In addition to retarding the rate of heat transfer through said wall, thereby reducing or eliminating the formation of condensate on its inner surface, said slab also substantially prevents the approach of ground moisture to the wall, so that it cannot pass through cracks or other imperfections of said wall.

Another object is the provision of a material of the character described in which the insulating slab is provided with flow passages through which moisture may flow downwardly to the base of the wall, where it may be disposed of by additional drainage means. These passages may take the form of grooves cut into either or both surfaces of the insulating slab, preferably in a diamond pattern fo reasons to be discussed hereinbelow.

A further object is the provision of a material of the character described which additionally provides means for preventing the clogging of the flow passages by silt or the like, so as to maintain them open for the flow of moisture. This means may take the form of a sheet of filter cloth applied over the grooves of the insulating slab, the interstices of the filter cloth permitting the passage of water, but not of sand, silt or the like.

A still further object is the provision of a material of the character described having a layer of loosely compacted fibrous material interposed between the filter cloth and the insulating slab. The fibrous material may enter the water flow grooves responsively to heavy crushing pressure on the material, and in so doing will prevent complete closure of the grooves and maintain water flow therethrough. The fibrous material also serves to improve the thermal insulation properties of the slab, and to reduce damage to the material by settling or shifting of the backfill material.

Still another object is the provision of a material of the character described, to be used when a perforated drainage pipe is laid around the base of the wall, in which the filter cloth of the material is extended to form a flap to be laid over the drainage pipe prior to backfilling. The flap protects the drainage pipe against clogging by ground silt, and permits the backfill to be made with ordinary soil, rather than the more expensive crushed rock, or gravel commonly used for this purpose.

Other objects are simplicity and economy of construction, and efficiency and dependability of operation.

Figure 4:
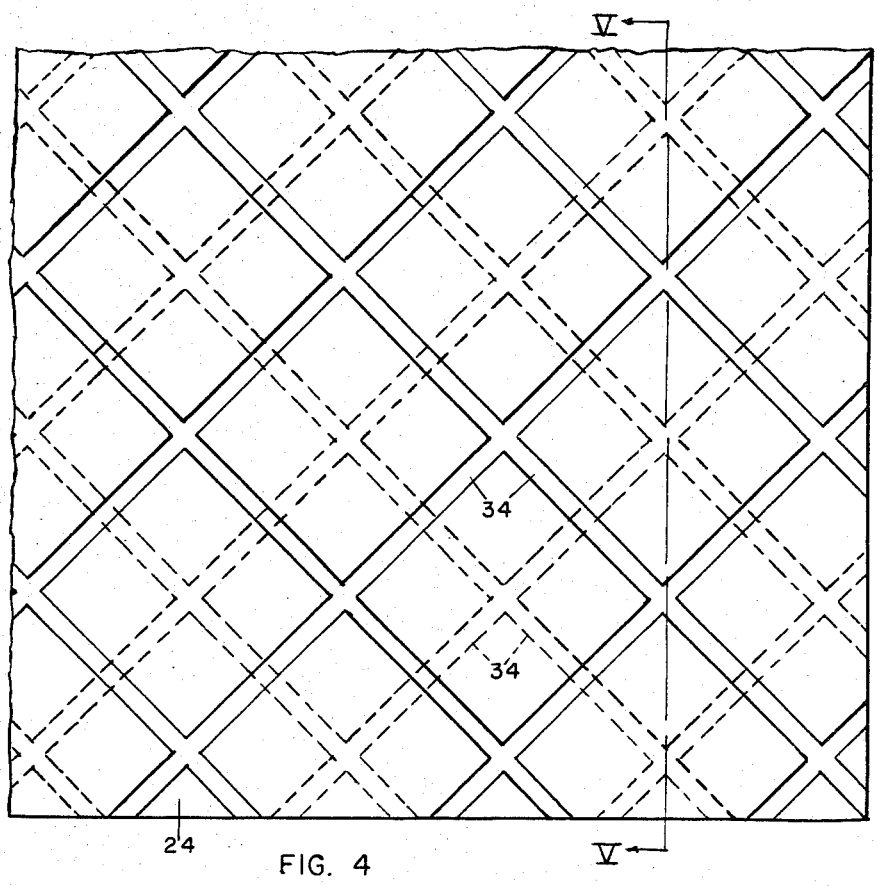
Figure 5:
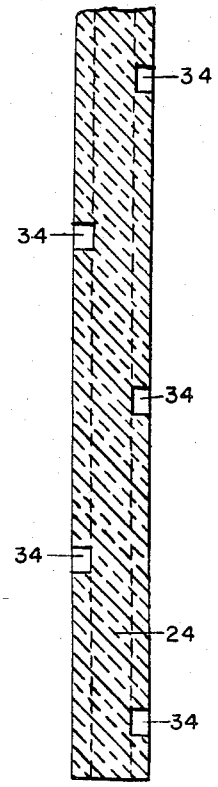
Figure 6:
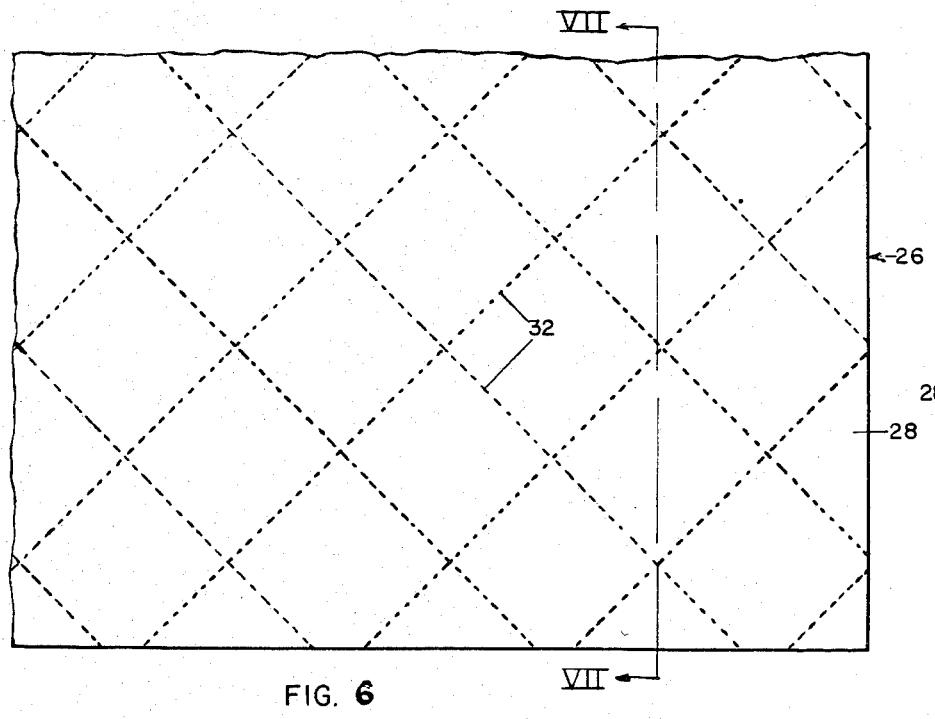
Figure 7:
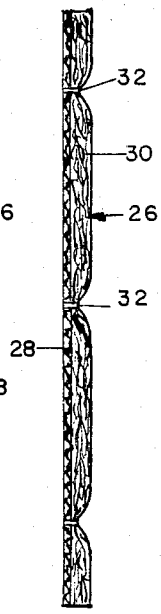

With these objects in view, as well as other objects which will appear in the course of the specification, reference will be had to the accompanying drawing, wherein:

FIG. 1 is a vertical cross-sectional view of a subterranean basement wall and related elements, showing a drainage and insulating material embodying the present invention applied operatively thereto, FIG. 2 is an enlarged fragmentary view of the lower portion of FIG. 1, FIG. 3 is a cross-sectional view of a section of the drainage and insulating material, shown full size, FIG. 4 is a face view of a portion of the insulating slab incorporated in the material, FIG. 5 is a sectional view taken on line V—V of FIG. 4, FIG. 6 is a face view of a portion of the filter sheet incorporated in the material, and FIG. 7 is a sectional view taken on line VII—VII of FIG. 6.

Like reference numerals apply to similar parts throughout the several views. FIGS. 1 and 2 illustrate a generally standard installation of a basement or other subterranean wall 2 of a dwelling or other building. A basement excavation 4 is first dug, the side wall 6 of said excavation usually being inclined outwardly as shown to avoid cave-ins until the basement is completed. A low concrete base or foundation wall 8 is then poured around the periphery of the basement and projects above the floor of the excavation. With suitable forms, wall 2 is then poured to rest solidly on base 8, with the thickness of the wall less than the width of the base to leave shoulders of the base exposed both inwardly and outwardly of the wall. Plumbing pipes and the like are then arranged on the base of excavation 4, and then covered with gravel 10 or the like up to the level of the top of the base. The basement floor 12 is then poured to rest on the inner shoulder of base 8, whereby to resist inward displacement of the lower edge of wall 2. A drainage pipe 14 is then laid around the periphery of the basement, outwardly of base 8. Said pipe is perforated, principally at its sides as indicated in FIG. 2 at 16, to receive moisture draining downwardly along the exterior of wall 2, and extends to a point of the terrain lower than the basement floor, for the disposition of the moisture. The excavation, exteriorly of wall 2, is then backfilled as indicated at 18, up to ground level, which preferably slopes away from wall 2 to direct surface moisture away from the wall. It has heretofore been considered to be necessary or desirable that the backfill 18 be formed entirely, or at least all of the lower portion thereof, of gravel or crushed rock, in order to prevent drainage pipe 14 from being rapidly clogged by ground silt entering through its perforations.

The structure thus far described is generally standard and is very widely used, but is not particularly effective in preventing the passage of water through wall 2 in long periods of time. As is well known, imperfect pouring of the wall may leave more or less minute apertures through which ground moisture may pass. Also, the wall may develop cracks through which water may pass, due to stresses imposed thereon by shifting or settling of the ground, or by thermal stresses induced by expansion and contraction due to changing temperatures. These problems are not completely solved by a sealant coating, usually petroleum-based and applied by brush to the exterior surface of the wall before backfilling, as indicated at 20 in FIG. 2. Such a sealant coating is often scratched, scraped or otherwise damaged by rocks in the backfill and wall cracks of course do not normally develop until a much later time. Also, it is well known that, where the wall 2 is relatively thin, and especially in warm and humid climates, the rate of heat transfer outwardly through the wall to the relatively cold ground may be so great that the inner wall surface is cooled to the point that condensate forms thereon, producing "wet" basement walls.

As a solution to these problems, the present invention provides a composite panel 22 adapted to be applied to the exterior surface of wall 2 in completely covering relation thereto, before backfilling, from the outer shoulder of base 8, on which it initally rests, up to or nearly up to ground level, as shown in FIG. 1. Actually, it is considered that the panels be manufactured and sold in standard sizes, rectangular in form, having a height equal to a standard basement depth, and in different widths, to the end that the entire wall may be covered by placing the proper panels in edge-to-edge relation. Each panel 22 (only one of which is shown) comprises a relatively thick, planar slab 24 of a thermal insulating material, completely wrapped in a filter sheet indicated generally by the numeral 26 and consisting of an outer layer 28 of filter cloth and an inner layer 30 consisting of a loosely compacted mat of fibrous material "quilted" to cloth 28 by spaced lines of stitching 32. All of the materials included in panel 22 are substantially moisture impervious, and highly resistant to deterioration by ground moisture. For example, in tests conducted on this material, a beaded styrofoam has been used for slab 24, an acetate tricot has been used for cloth 28, polyester fiber has been used for fiber layer 30, and acetate thread for stitching 32, and all have performed satisfactorily. However, these specific materials are exemplary only, and others might be equally satisfactory.

The styrofoam slab 24 may be perhaps one inch in thickness, and has spaced apart parallel grooves 34 formed at right angles in both the inner and outer surfaces thereof. Preferably, these grooves are inclined from horizontal in a diamond pattern, as best shown in FIG. 4, for better drainage as will appear. The grooves on the opposite faces of the slabare preferably staggered relative to each other, also as indicated in FIG. 4, in order to avoid undue weakening of the slab. Materials having a high insulation value, including styrofoam, are relatively weak in structural strength, and slabs thereof may be easily broken, as well as having relatively small resistance to crushing when loads are applied to highly localized areas thereof. Materials structurally stronger than styrofoam could be used, such as certain fiberboard, but they have correspondingly lower insulation values. The grooves are distributed evenly over the entire area of the slab, and open through the top, bottom and side edges thereof.

The cloth layer 28 of filter sheet 26 may be formed of an acetate tricot fabric having interstices small enough to prevent the passage of sand or silt, while still permitting the passage of water. Stitching 32 may also be acetate thread. The entire filter sheet 26, including cloth layer 28 and fiber layer 30, is wrapped about slab 24 in totally enveloping relation thereto, including its top, bottom and side edges as well as its inner and outer faces, and is secured in place by stitching, stapling, or any other satisfactory manner. At or adjacent the edge of the panel which will eventually be its lower edge when installed, adjacent edge portions of the filter sheet are secured together by stitching 36 (see FIG. 2) and extended outwardly to form a free flap 38 consisting of a double thickness of the filter sheet.

In the installation, before backfilling but after drain pipe 14 is in place, the drain pipe is first covered with a small amount of gravel 40. A panel 22 is first rested on the outer shoulder of base 8, with flap 38 disposed at the lower edge thereof and at the outer side thereof. If a sealant 20 has previously been applied to wall 2 and is still tacky, the panel will adhere thereto and be held in place. Flap 38 is then laid over gravel 40 as shown. When wall 2 has been completely panelled, backfill 18 may be completed with ordinary soil and dirt, such as that removed in digging excavation 4. Flap 38 will filter silt from ground moisture approaching pipe 14. This permits the great bulk of the backfill to be made with ordinary dirt available on site, rather than relatively costly gravel or the like, and thus provides a valuable feature of economy.

In the general operation of the panel, it will be seen first that insulating slab 24 will very materially decrease the rate of heat transfer from the relatively warm interior of the basement to the relatively cold outside earth, thereby maintaining the interior surface of wall 2 relatively warm to inhibit the formation of water condensate thereon. In the water drainage aspect of the panel operation, it will be seen that ground moisture in backfill 18 can pass through the outer layer of filter cloth 28, but no appreciable amounts of sand, silt or the like. The outer layer of fibrous material 30 also serves a filter function, tending to trap and retain any silt particles which may pass through the filter cloth layer. Both the outer and the inner layers of fibrous material 30, when partially compressed by the pressure of the backfill against the panel, also tend to trap air therein, thereby forming "dead-air" zones which improve the thermal insulation value of the panel. Thus virtually only a pure liquid, containing little if any silt, enters the grooves 34 at the outer surface of slab 24, and flows downwardly through said grooves to the lower edge of the panel, where it flows outwardly through the filter material and finds its way to drain pipe 14 for disposal. Even if drain pipe 14 were not present, water would escape to the ground below the level of basement floor 12, and could not flow into the basement.

Very little moisture should normally pass through slab 24 so long as it remains intact, so long as it is formed of moisture impervious material. However, the lightweight material of the slab may be imperfectly formed, leaving small openings therethrough through which water may pass, and furthermore, being inherently fragile, it may be cracked, broken, crushed or pierced in the described environment, for example by heavy rocks which may be included in the backfill material, which may fall against panel 22 and damage it as the backfill is placed. If such damage occurs, more water will flow through the slab 24 in the damage areas, but any water passing through the slab will enter the grooves 34 at the inner face thereof, and flow downwardly therethrough for disposal at the lower edge of the panel as previously described. The layer of the filter sheet 26 disposed below the lower edge of slab 24 holds the slab apart from the outer shoulder of base 8. and permits water to pass outwardly thereunder. This is one function of the described "edge-wrapping" of the slabs with the filter sheet. Another valuable function of the edge-wrapping is that if wall 2 is covered by a series of the described panels, the edge-wrapping provides that the filter sheet forms an effective seal between the edges of adjacent panels, preventing the passage of silt therebetween, so long as the panels are applied in snugly abutting edge-to-edge relation. The edge-wrapping also seals the ends of grooves 34 against the entry of silt thereto where necessary. The inner layer of filter cloth 28, directly against wall 2, of course serves little or no filtering function, but is useful in holding all of the panel parts in snug, secure assembly as the panel is manufactured, and until it is finally installed as shown. If found more economical, some material other than filter cloth could be utilized in this layer.

In addition to the filtering and insulating functions of fibrous material 30, described above, said fibrous material also functions in many cases to hold the water flow grooves 34 of slab 24 effectively open in the event the slab is partially crushed. In this case, portions of the fibrous material enter the grooves in the crushed area, and are compacted therein to resist complete closure of said grooves. The partially closed grooves are then filled with the compacted fibers, but the fibers can still provide fluid flow passages through which water can pass. Similarly, the fibrous layer functions to prevent the outer layer of filter cloth 28 from being collapsed or pressed into the outer grooves of slab 24 to the extent that said grooves are completely closed. If the extent of crushing of the panel is in any case sufficiently great to materially reduce the water flow capacity of grooves 34 in the area damaged by the crushing, and of course if the crushing is so severe as to close the grooves in the damaged area completely, then the diamond pattern of the grooves becomes important. This pattern permits water to flow downwardly through the grooves to the damaged area, then laterally outwardly around and back beneath the damaged area. This avoids any possibility that water will be dammed up and retained in the grooves above any localized damaged area. Another basic function of the fibrous material is that it permits the flow of water therein parallel to the plane of the slab so that the water may flow to grooves 34.

Another valuable function of fibrous filter layer 30 is that, being fibrous and normally only loosely compacted, it is readily yieldable in its own plane. This permits a substantial degree of relatively free movement of the filter sheet 26, in its own plane, relative to insulating slab 24. This movement may be caused, for example, by settling and shifting of backfill material 18 over long periods of time, or by cracking and shifting of portions of wall 2 itself. The movability of filter sheet 26 relative to slab 24 will, within reasonable limits, accomodate these movements with no essential damage either to the filter sheet or to the insulating slab, and hence preserve the structural integrity of the entire panel 22.

Actually, very substantial benefits of both moisture drainage and insulation could be obtained if grooves 34 were formed only in either surface of slab 24, rather than in both surfaces thereof as illustrated, so long as filter sheet 26 covers both surfaces. This variation is considered to be within the preview of the present invention. However, if only the outer surface were grooved, any water passing through slab 24 due to imperfections thereof or damage thereto, it might collect between the panel 22 and wall 2, and eventually find a way through the wall. If only the inner surface were grooved, only water passing through the slab due to imperfections of or damage to said slab would flow in said grooves, while the main drainage flow would necessarily occur downwardly in the outer fibrous layer 30. While this fibrous material normally remains sufficiently open to permit water flow, and is protected from clogging with silt by the outer filter cloth layer 28, the flow capacity at the outer surface of the panel would nevertheless be substantially reduced as compared to that provided by the grooves 34 of the outer slab surface Therefore, the grooving of both surfaces of slab 24 is preferred.

While we have shown and described a specific embodiment of our invention, it will be readily apparent that many minor changes of structure and operation would be made without departing from the spirit of the invention.

What we claim as new and desire to protect by Letters Patent is:

1. A drainage material for subterranean walls comprising a plurality of generally planar panels adapted to be applied in edge-to-edge relation substantially covering the exterior surface of said wall, while said wall is still free-standing and prior to the application of backfill material to said outer wall surface, each of said panels including:

a. a planar slab formed of a material which is normally substantially moisture impervious, but subject to the passage of moisture therethrough as a result of possibly imperfect manufacture thereof, or as a result of cracking, breaking, crushing or piercing thereof by heavy rocks included in the backfill material when said material is applied, said slab having fluid flow passages formed therein parallel to its plane through which ground moisture may flow downwardly to the lower edge of said panel by gravity, said passages opening exteriorly of said slab at areas distributed evenly over the entire area of at least one face thereof to permit said ground moisture to enter thereinto, and b. a sheet of filter material covering any surface of said slab through which said flow passages open, whereby to permit the passage of moisture to said flow passages therethrough, but to inhibit the passage of sand, ground silt or the like.

2. The material as recited in claim 1 wherein said flow passages open through the inner surface of said slab, that being the surface to be disposed adjacent said wall.

3. The material as recited in claim 1 wherein said flow passages open through the outer surface of said slab, that being the surface to be disposed facing outwardly from said wall.

4. The material as recited in claim 1 wherein said flow passages open through both the inner and outer surfaces of said slab.

5. The material as recited in claim 1 wherein said flow passages are formed by evenly spaced grooves formed in a surface of said slab and distributed over the entire area thereof.

6. The material as recited in claim 5 wherein said grooves are vertically inclined and arranged in a diamond pattern, whereby to maintain downward flow of moisture around any area of the slab in which said grooves may be closed by crushing of the slab by heavy rocks in the backfill material.

7. The material as recited in claim 1 wherein said filter sheet comprises an outer layer of relatively stout filter cloth, and an inner layer of loosely compacted fibrous material, whereby moisture passing through said cloth may flow through said fibrous material in a direction parallel to the plane of the slab to gain access to said flow passages, and whereby said filter cloth may shift in a direction parallel to its plane relative to said slab, responsively to shifting or settling of the backfill material, to avoid damage to said panel.

8. The material as recited in claim 7 wherein said flow passages constitute spaced grooves formed in a surface of said slab, and wherein the inner fibrous layer of said filter sheet is yieldably compressible to a substantial degree, whereby to be pressed into said grooves in areas of said slab which may be partially crushed by rocks or the like contained in said backfill material, in order to resist complete closure of said grooves in those areas, and thereby to permit continued flow of moisture through said passages.

9. The material as recited in claim 1 wherein said flow passages open through both faces as well as the edge surfaces of said slab, and wherein said filter sheet completely envelops the entire slab, covering both faces as well as the edge surface thereof, whereby not only better to protect said flow passages against clogging by silt, but also to form a seal between adjacent panels applied to said wall.

10. The material as recited in claim 1 for use when a perforated ground drainage pipe is disposed along the base of said wall, exteriorly thereof, and wherein said filter sheet is provided with an outwardly extended loose flap at or adjacent the lower edge of said panel, said flap being adapted to be laid over said pipe, prior to backfilling, whereby to protect said pipe against clogging by silt.

11. The material as recited in claim 1 wherein said filter sheet is comprised completely of substantially moisture impervious material.

12. The material as recited in claim 1 wherein said flow passages are formed by grooves in both faces of said slab, said grooves of each face being vertically inclined, and arranged in a diamond pattern covering substantially the entire area of the slab face, and wherein said filter sheet completely envelops said slab, said filter sheet comprising an outer layer of stout filter cloth, and an inner layer of loosely compacted fibrous material.

13. The material as recited in claim 1 wherein the material of which said slab is formed also possesses good thermal insulating qualities.

* * * * *